US008814762B2

(12) United States Patent
Butler et al.

(10) Patent No.: US 8,814,762 B2
(45) Date of Patent: Aug. 26, 2014

(54) INELASTIC STRAP BASED EXERCISE APPARATUS

(75) Inventors: Jaremy Butler, Herriman, UT (US); William T. Dalebout, North Logan, UT (US)

(73) Assignee: ICON IP, Inc., Logan, UT (US)

( * ) Notice: Subject to any disclaimer, the term of this patent is extended or adjusted under 35 U.S.C. 154(b) by 95 days.

(21) Appl. No.: 13/290,719

(22) Filed: Nov. 7, 2011

(65) Prior Publication Data

US 2013/0005544 A1 Jan. 3, 2013

Related U.S. Application Data

(60) Provisional application No. 61/411,394, filed on Nov. 8, 2010.

(51) Int. Cl.

| | |
|---|---|
| ***A63B 21/002*** | (2006.01) |
| ***A63B 21/068*** | (2006.01) |
| ***A63B 21/00*** | (2006.01) |
| ***A63B 21/16*** | (2006.01) |
| ***A63B 23/12*** | (2006.01) |
| ***A63B 7/02*** | (2006.01) |
| *A63B 71/02* | (2006.01) |
| *A63B 23/00* | (2006.01) |

(52) U.S. Cl.

CPC ..... *A63B 7/02* (2013.01); *A63B 2225/093* (2013.01); *A63B 21/1484* (2013.01); *A63B 21/1663* (2013.01); *A63B 23/1236* (2013.01); *A63B 21/068* (2013.01); *A63B 2210/50* (2013.01); *A63B 23/1218* (2013.01); *A63B 2225/09* (2013.01); *A63B 21/002* (2013.01); *A63B 21/16* (2013.01); *A63B 21/1469* (2013.01); *A63B 71/02* (2013.01); *A63B 23/1227* (2013.01); *A63B 2023/006* (2013.01); *Y10S 482/904* (2013.01)

USPC ..... 482/96; 482/91; 482/904

(58) Field of Classification Search

USPC ..... 482/23–24, 37, 91–96, 121–126, 482/129–131, 139, 904; 602/34

See application file for complete search history.

(56) References Cited

U.S. PATENT DOCUMENTS

| | | | | |
|---|---|---|---|---|
| 3,672,124 | A * | 6/1972 | Pirotta | 54/39.1 |
| 5,407,411 | A * | 4/1995 | Trainor | 482/95 |
| 5,595,559 | A * | 1/1997 | Viel | 482/91 |
| 6,113,564 | A * | 9/2000 | McGuire | 602/32 |
| 6,175,994 | B1 * | 1/2001 | Nicoletti | 24/68 SK |
| 2010/0292056 | A1 * | 11/2010 | Birch et al. | 482/129 |

* cited by examiner

*Primary Examiner* — Loan H Thanh
*Assistant Examiner* — Jennifer M Deichl

(57) ABSTRACT

An inelastic exercise apparatus includes an elongated member having a pair of ends. The elongated member is an inelastic strap. The apparatus also includes an anchor having a first portion for mounting to a structure and a second coupling portion. The exercise apparatus further includes a rigid yoke including a yoke housing having a first end and a second end, wherein the first end of the yoke housing is coupled to the second coupling portion of the anchor and the second end of the yoke housing defines a translation channel configured to receive the elongated member.

17 Claims, 15 Drawing Sheets

INELASTIC STRAP BASED EXERCISE APPARATUS

BACKGROUND

Exercise apparatuses traditionally employed free weights to be lifted by the user or a weight stack actuated by a cable which is pulled by users of the apparatus. Recently, resistive elastic members, such as bands or plates, have been incorporated into exercise equipment to provide motion resistance. While these apparatuses provide beneficial resistive training, they are often relatively large and heavy, which prevents them from being easily transported and/or stored.

More recently, resistance exercise devices made nearly entirely of elastic bands have been gaining popularity. These elastic bands typically restrict the motion of a user's arms and/or legs, or the motion between the user and a support structure. Elastic exercise devices can be small, even portable, but have limited usefulness that results from their resistance characteristics, which depend on the length and elasticity of the elastic band. As a result of these characteristics, the elastic bands are useful for a specific length range, thus restricting the diversity of exercises for which it can be used. In addition, it may not be possible for different users to use the same device for the same exercise due to differences in height, weight, or strength between different users. Thus, for an elastic device to be generally useful, such as to provide a complete workout or to allow for different users, a plurality of elastic bands are required that must be easily interchangeable.

Another limitation of elastic resistance exercise devices is that the resistance is inconsistent and increases with increasing displacement, and also tends to snap back when the user decreases his or her effort. While this resistance response provides for a compact design, it is problematic as it does not recreate the resistance encountered by muscles during more natural types of exercising, such as running, swimming, etc. Yet another limitation of elastic devices is the inability to support a wide range of user weight. Rather, the devices are typically adapted to support only the resistance provided by the user's muscles. This further limits the exercises that can be performed by any individual elastic device. For this reason, elastic devices must be used over a limited range of stances, further limiting the user's workout.

Another type of resistance exercise device provides an inelastic strap that is attachable to a fixed location such as, for example, a door. These devices may overcome some of the limitations of the elastic devices previously discussed by providing inelastic straps that can be anchored between a door and a door jamb. Many traditional apparatuses incorporating inelastic straps have a fixed length and are limited in the range of exercises for which they can be used.

One type of resistance band apparatus is disclosed in U.S. Pat. No. 7,044,896 issued to Randal A. Hetrick and assigned to Fitness Anywhere, Inc. In this patent, an exercise device includes an inelastic adjustable length member with two arms and a grip at both ends. The inelastic adjustable length member is attached to a centrally located, flexible, strap based anchor that provides for a distribution of the length between the arms.

SUMMARY

In one aspect of the disclosure, an adjustable inelastic exercise apparatus includes an elongated member having a pair of ends, wherein the elongated member is a substantially inelastic strap.

Another aspect of the disclosure may include any combination of the above-mentioned features and may further include an anchor having a first portion for mounting to a structure and a second coupling portion.

Another aspect of the disclosure may include any combination of the above-mentioned features and may further include a substantially rigid yoke including a yoke housing having a first end and a second end, wherein the first end of the yoke housing is coupled to the second coupling portion of the anchor and the second end of the yoke housing defines a translation channel configured to receive an elongated member.

Another aspect of the disclosure may include any combination of the above-mentioned features and may further include the substantially rigid yoke further including at least one fixation member configured to selectively fix a position of an elongated member within the translation channel.

Another aspect of the disclosure may include any combination of the above-mentioned features and may further include the at least one fixation member including a positioning pin including a shaft and at least one shaft receiving orifice defined by the yoke housing adjacent to the translation channel, the at least one shaft receiving orifice being sized to securely receive the shaft.

Another aspect of the disclosure may include any combination of the above-mentioned features and may further include a fixation feature formed on the substantially inelastic strap, the fixation feature being sized to receive the shaft when inserted in the at least one shaft receiving orifice to positionally fix the substantially inelastic strap in the translation channel.

Another aspect of the disclosure may include any combination of the above-mentioned features and may further include a fixation feature formed substantially on a center point of the substantially inelastic strap.

Another aspect of the disclosure may include any combination of the above-mentioned features and may further include a loop formed on a top surface of the substantially inelastic strap.

Another aspect of the disclosure may include any combination of the above-mentioned features and may further include a plurality of fixation features formed on the substantially inelastic strap.

Another aspect of the disclosure may include any combination of the above-mentioned features and may further include a first shaft receiving orifice defined by a front surface of the yoke housing and a second shaft receiving orifice defined by a back surface of the yoke housing, wherein when a shaft is inserted into the first shaft receiving orifice and the second shaft receiving orifice the shaft traverses the translation channel.

Another aspect of the disclosure may include any combination of the above-mentioned features and may further include a cam rotatably coupled to the yoke housing within the translation channel.

Another aspect of the disclosure may include any combination of the above-mentioned features and may further include a yoke engagement surface formed on the second end of the yoke housing, wherein the yoke engagement surface defines a lower portion of the translation channel.

Another aspect of the disclosure may include any combination of the above-mentioned features and may further include the yoke being formed from a first material and the yoke engagement surface being formed of a second material, wherein the second material has a lower coefficient of friction than the first material.

Another aspect of the disclosure may include any combination of the above-mentioned features and may further include a removable insert member configured to removably engage with the yoke engagement surface.

Another aspect of the disclosure may include any combination of the above-mentioned features and may further include a flexible loop formed on the second coupling portion of the anchor and a an anchor orifice formed on the first end of the yoke defined by the yoke housing, the anchor orifice being coupled to the flexible loop.

Another aspect of the disclosure may include any combination of the above-mentioned features and may further include an anchor structure including a first strap loop folded in a first fold direction and a second strap loop folded in a second fold direction, wherein the first strap loop and the second strap loop are positioned adjacent to one another such that the first fold direction and the second fold direction are converging.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

An inelastic strap based exercise apparatus configured to provide selective grip positioning and controllable motion resistance is provided herein. Specifically, the present system provides an inelastic based exercise apparatus that includes a vertical positioning anchor, a substantially rigid yoke housing, a central inelastic strap, and at least one handle or user engagement device. According to one embodiment, the central inelastic strap includes at least one pin engagement feature, such as a loop, that is selectively fixed to the rigid yoke housing via the insertion of a pin or other fixation member. Accordingly, the selective fixation of the inelastic strap to the rigid yoke housing provides added stability and positional assurance of handle location for desired exercises. Furthermore, as will be described below with reference to the figures, the present system may also include a number of removable friction modifying members configured to selectively modify the friction resisting movement of the strap within the substantially rigid yoke housing while adding durability to the portion of the system that will likely be exposed to the greatest frictional forces. A number of structures and methods of the present resistance based exercise system are described in detail below.

As used herein, the term "strap" shall be interpreted broadly both here and in the appended claims as any long, pliable strip of material including, but in no way limited to, leather, cloth, nylon, polyethylene, polypropylene, cotton, linen, hemp, and the like. Additionally, for ease of explanation only, the present strap is illustrated as a substantially flat strap. However, the strap incorporated by the present system and method may assume any number of cross-sectional geometries, including flat, circular, square, rectangular, etc.

As used herein, the term "yoke" shall be interpreted broadly both here and in the appended claims as including any substantially solid member free of moving parts configured to facilitate coordinated movement of two separate items or two ends of a single item, such as a strap.

Furthermore, as used herein, the term "rigid" shall be interpreted broadly both here and in the appended claims as including any material or object that is incapable of or highly resistant to bending.

In general, the present system and method provides an inelastic exercise device that is supported by, or that can be easily attached to, a supporting structure, and that allows a user to perform a large number of exercises by easily adjusting the length of the device, selectively fixing the relative position of the handles, and thereafter balancing the device as the user transfers his weight to the device. Several of the features of the present system and method will now be illustrated with reference to FIGS. 1A-1B, which show the set-up and use of the present system and method, and which is not meant to limit the scope of the system and method in any way.

Figure 1A:
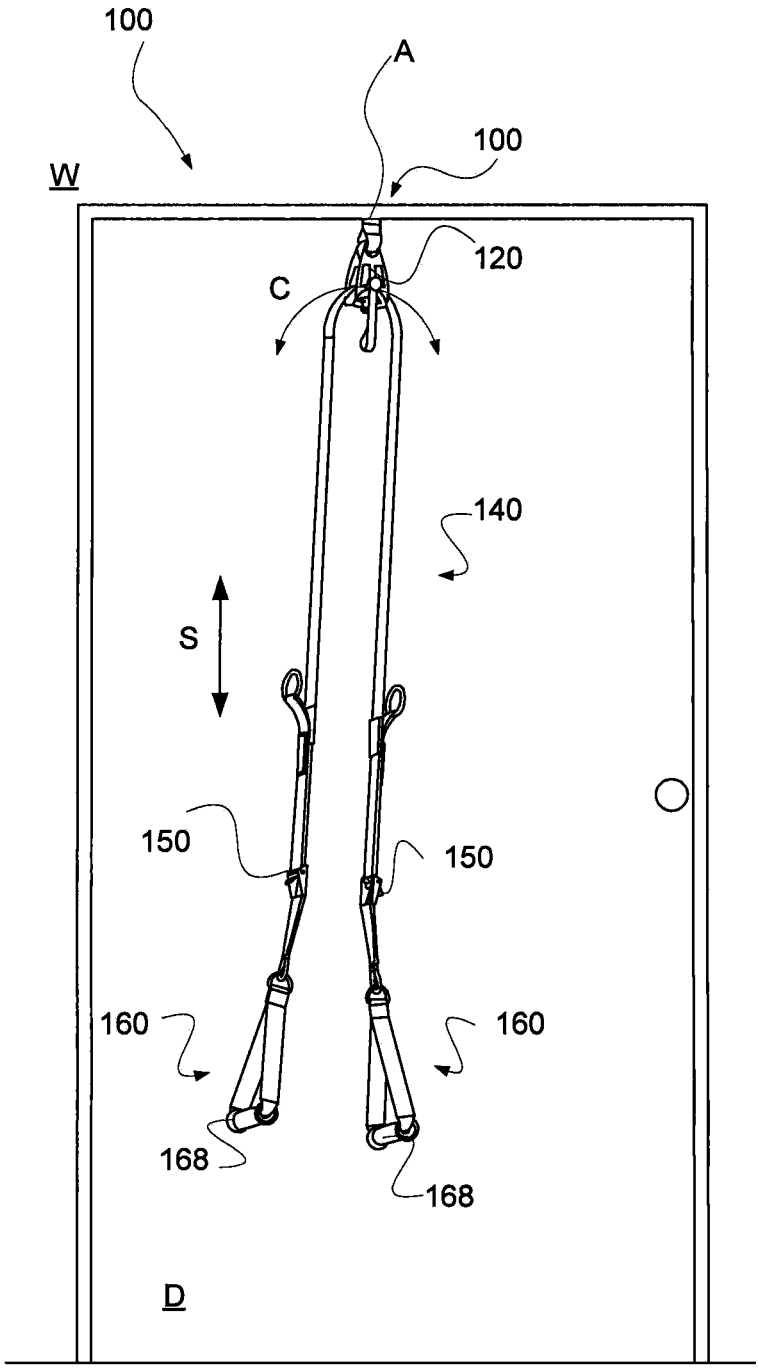
FIG. 1A is a front view of an exercise device anchored between a door and a door jamb, according to one embodiment.

As illustrated, FIG. 1A is a schematic front view of one embodiment of an inelastic based exercise device 100 that is anchored at a point A between a door D and door jamb J.

Figure 1B:
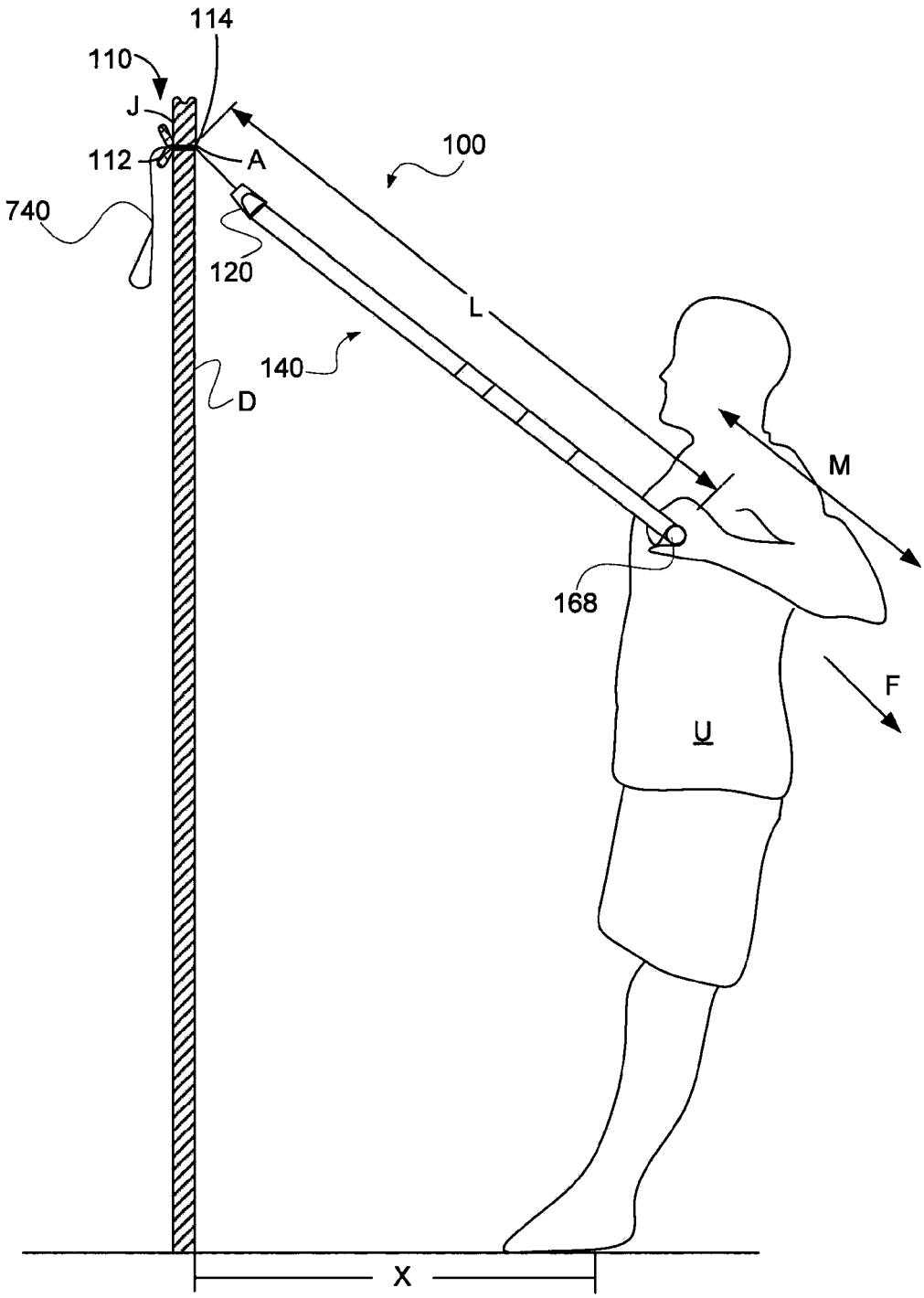
FIG. 1B is a side cross-sectional view of a user performing a high row exercise with the exercise device of FIG. 1A, according to one embodiment.

Similarly, FIG. 1B is a partial sectional view illustrative of a user U exercising with the exercise device of FIG. 1A. Further details of the inelastic based exercise device will be provide below. As used herein, the term "inelastic" shall be interpreted as any material having a Young's Modulus of greater than 0.5 GPa.

As illustrated in FIGS. 1A and 1B, the present exercise device 100 generally includes an anchor 110 and an elongated member 140 forming a pair of arms on either side of the anchor, as shown schematically in FIGS. 1A and 1B. As illustrated, the anchor 110 is coupled to the elongated member 140 via a substantially rigid yoke 120. According to one embodiment, a pair of grips 168 is provided at the end of handles 160 coupled to the ends of the elongated member 140. According to this embodiment, the elongated member 140 includes least one length adjustment mechanism 150 that provides for increasing or decreasing the length S, as indicated by double arrows S. Additionally, the elongated member 140 terminates on each end with an extension engagement member 154 (FIG. 1C), such as a carabineer, which attaches to the handles 160 and corresponding grips 168.

Anchor 110 is used to provide a fixed anchor point for exercise device 100 and to support a user's weight as it is applied to the handles 160 and the connected elongated member 140, as indicated by an arrow F in FIG. 1B. As shown in FIG. 1B, anchor 110 is adapted for positioning exercise device 100 in a door and providing support to elongated member 140 by having an enlarged portion or anchor base 112, an anchor strap portion 114, and a loop coupled to a substantially rigid yoke 120 for selectively supporting the elongated member in a sliding or fixed configuration. With the anchor base 112 on the opposite side of door D from the elongated member 140, the anchor 110 supports the weight of a user as grips 168 are pulled, as illustrated in FIG. 1B. In addition, the yoke 120 allows for the selective translation of the elongated member there through, as shown in FIG. 1A by double arrow C. Thus, the total length of elongated member 140 and distribution of that length on each side of the yoke 120 can be easily adjusted through the at least one length adjustment mechanism 150 and by pulling the ends of the elongated member. Depending on the orientation of the elongated member 140 in the yoke 120 and the use of the adjustment mechanism 150, the arms formed by the elongated member may have similar or varying lengths L.

When supported by a structure, such as door D (shown in FIGS. 1A-1B) or a railing, pole, tree, swing set or any other appropriate support member (not shown) the present exercise device provides a pair of grips 168 for a user to exercise using the person's weight according the user's position relative to the device, and provides for easily adjusting the length of the device. Furthermore, as described below, the present exercise device can be used to exercise in any one of a large number of orientations according the selected adjustable length, selective fixation of the elongated member 140 in the yoke 120, and according to where and how the user is positioned relative to the exercise device.

With reference to FIG. 1B, a user U is shown in one of the many exercise positions, in particular a high row exercise, gripping the pair of grips 168 with the user's hands and having the user's feet placed a horizontal distance X from anchor point A. When anchored to a door, it is preferred that anchor point A is on the inwards side of the door (that is, that the door open away from user U) so that jamb J can support the user's weight. The user U is shown leaning away from anchor point A and supporting a fraction of his or her weight through device 100. According to one embodiment, the user U can vary the amount of supported weight, and thus the resistance of exercise device 100, by adjustment of his or her stance relative to anchor point A (distance X) and the length of the elongated member 140 and the resulting arms (length L). The user U of FIG. 1B can perform a high row exercise by moving his body in a direction M towards and away from anchor point A. While a high row exercise is illustrated in FIG. 1B, many other exercises are also possible with the user in this position by the user moving in other directions with the user's weight supported by the ground and exercise device 100.

Figure 1C:
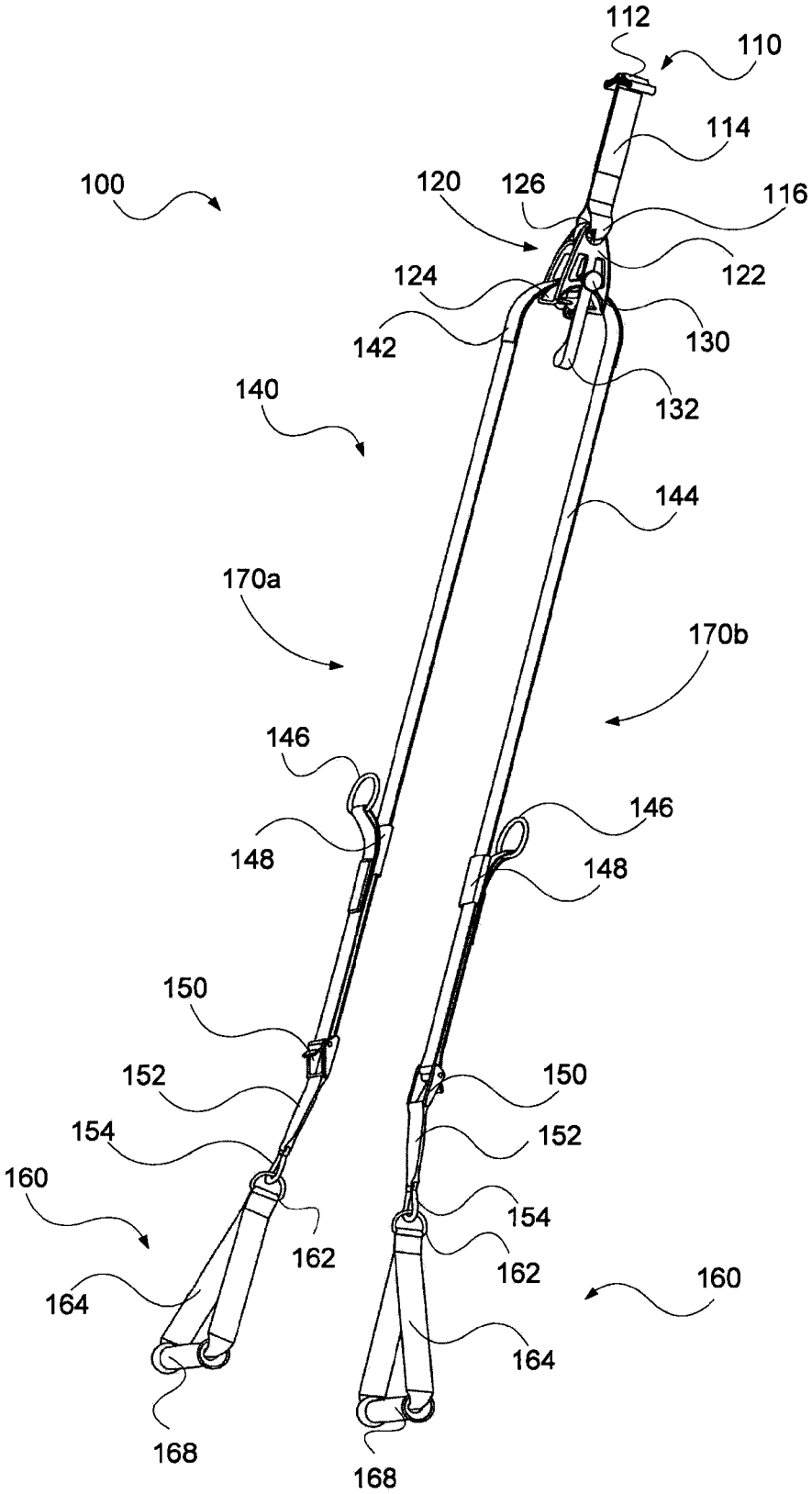
FIG. 1C is a detailed perspective view of the exercise device of FIG. 1A, according to one embodiment.

FIGS. 1C through 15 are detailed views of various embodiments of the exercising device 100. Referring first to FIG. 1C, a perspective view of exercise device 100 is shown as including an anchor 110 and an elongated member 140, coupled together via a substantially rigid yoke 120. According to the illustrated embodiment, anchor 110 includes an inelastic, flexible strap 114 having an enlarged first end or base 112 that is wider than the strap, and a second end that forms a coupling loop 116. According to the embodiment illustrated in FIG. 1C, the loop 116 passes through an anchor orifice 126 defined in the yoke 120, thereby pivotably coupling the anchor 110 to the yoke 120.

Figure 2:
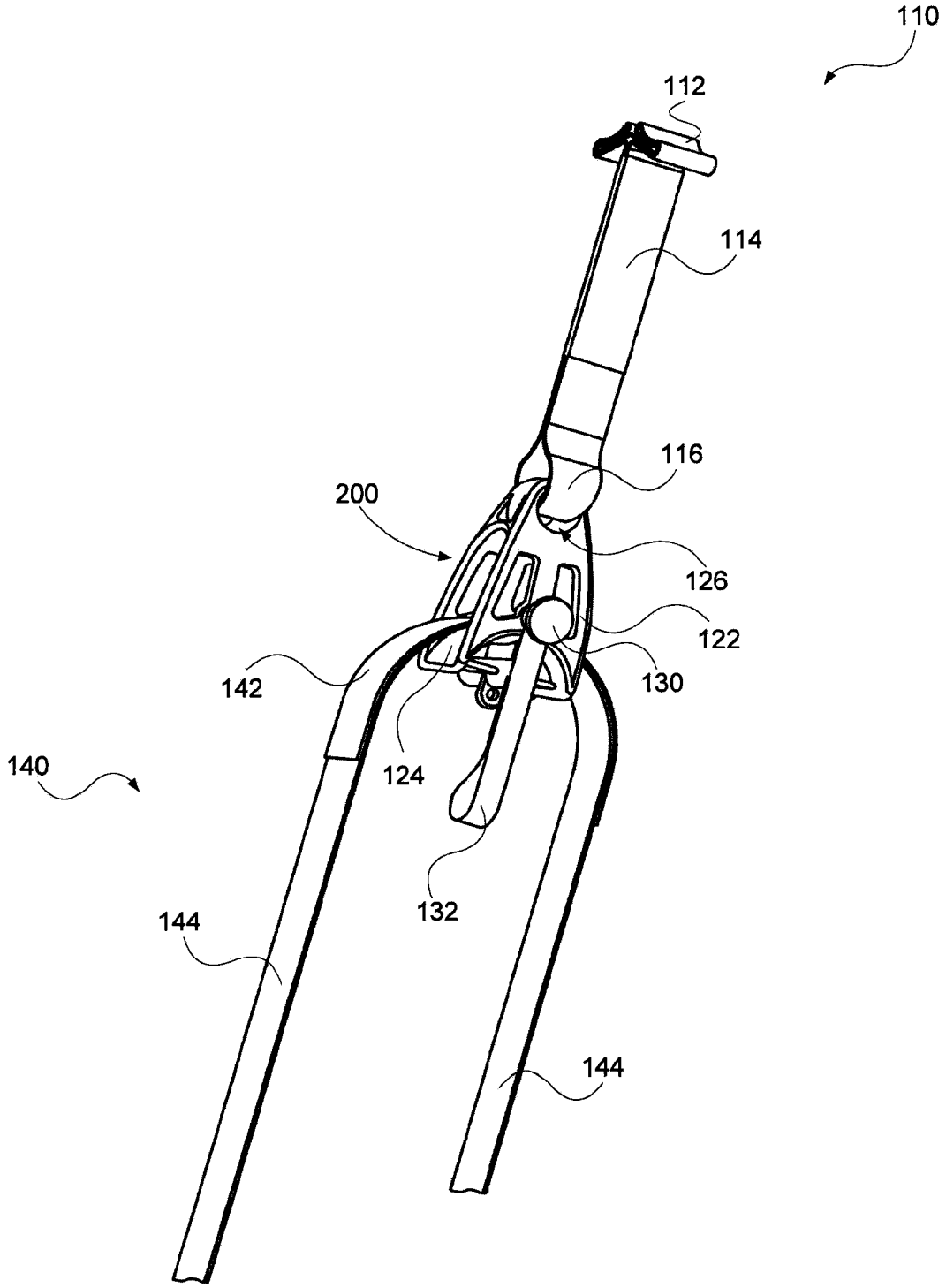
FIG. 2 is a magnified perspective view of the upper portion of the exercise device of FIG. 1C, according to one embodiment.

According to one embodiment, the yoke 120 includes a main yoke housing 122 defining the anchor orifice 126 that couples the loop 116 of the anchor 110 to the yoke. Furthermore, the yoke housing 122 defines a central strap translation channel (200; FIG. 2) with a strap engagement surface 124 configured to engage the elongated member 140 as it passes through the central strap translation channel. As used herein, the term "channel" shall be understood broadly as including any structure that provides a guide for directing the translation of an object, such as a strap. Furthermore, according to one embodiment illustrated in FIG. 1C, the substantially rigid yoke 120 includes features configured to selectively receive a positioning pin 130 that may include a pin strap 132.

Continuing with FIG. 1C, the elongated member 140 passes through the yoke 120, defining a pair of arms 170, indicated as arm 170*a* and 170*b*. Each arm 170 has a respective end terminating with an extension engagement member 154 configured to mate with a handle engagement member to couple one of a pair of handles 160 or other user engagement devices. As shown, the handles 160 may, according to one embodiment include grips 168 formed on handle loops 164 coupled to the handle engagement member 162. While a handle having a grip 168 is illustrated in FIG. 1C, any number of handles, straps, or other engagement members may be coupled to the extension engagement member 154 illustrated in FIG. 1C.

The elongated member 140 of the present exercise device 100 may also include a pair of length adjustment mechanisms or buckles 150, shown at either end of a central strap 144 that provide for the adjustment of the length of the elongated member. Specifically, according to one embodiment illustrated in FIG. 1C, the central strap 144 has a pair of engagement ends 146 disposed on each end. As illustrated, each end of the central strap 144 independently passes through a length adjustment mechanism 150, specifically a cam buckle, the design and use of which are well known in the art. As described subsequently, elongated member 140 is substantially inelastic, with the length of the elongated member being adjustable through the action of one or both of the length adjustment mechanisms 150. According to one specific embodiment, a user may actuate the cam on the length adjustment mechanism 150, allowing for translation of the central strap 144 through the buckle when the engagement ends 146 are pulled. More specifically, according to one embodiment, the length adjustment mechanisms 150 include a buckle having a cam that is spring loaded such that it normally restrains the strap 144, and that under the action of a user, such as by pushing or pulling the cam, the cam is moved to allow the strap to move. The distance between the cam and an opposing bar is adjusted by the user and a spring within the length adjustment mechanism 150 by pushing on the cam, allowing the strap 144 to slide between the cam and opposing bar. The translation of the central strap 144 through the buckle modifies the effective length of the elongated member 140 according to the desires of the user. When the desired length is achieved, the cam portion of the length adjustment mechanism 150 may be released, fixing the effective length of the elongated member 140. The portion of the central strap 144 that is pulled through the length adjustment mechanism 150 and doubled back on itself may be secured to the central strap via any number of securing members 148 including, but in no way limited to Velcro straps, sliding boots coupled to the central strap, and the like.

Extending from each length adjustment mechanism 150 is a buckle extension 152 terminating in the extension engagement member 154. As mentioned previously, the extension engagement member 154 is configured to enable attachment of any number of handles 160, loops, grips, straps and the like. As illustrated in FIG. 1C, the extension engagement member may include, but is in no way limited to a carabineer or other coupling device.

According to one embodiment a member fixation feature 142 that forms a portion of the central strap near the center of the central strap 144. According to one embodiment, features formed on the member fixation feature 142 are configured to be selectively engaged by the positioning pin 130 as it passes through the substantially rigid yoke 120, thereby fixing the position of the elongated member 140 relative to the yoke 120. Alternatively, when a user does not desire to fix the relative position of the elongated member 140 relative to the yoke 120, the member fixation feature 142 can be disengaged from the positioning pin 130, allowing the central strap to translate freely through the yoke. The ability to selectively fix the position of the elongated member 140 relative to the yoke 120 enables the performance of additional exercises while enhancing stability during the performance of numerous exercises. Additionally, the ability to selectively fix the position of the elongated member 140 relative to the yoke 120 aids beginning users attempting to overcome muscle imbalances when performing relatively new exercises. Further details of the individual components illustrated in FIG. 1C will be provided below with reference to FIGS. 2-15.

Figure 3:
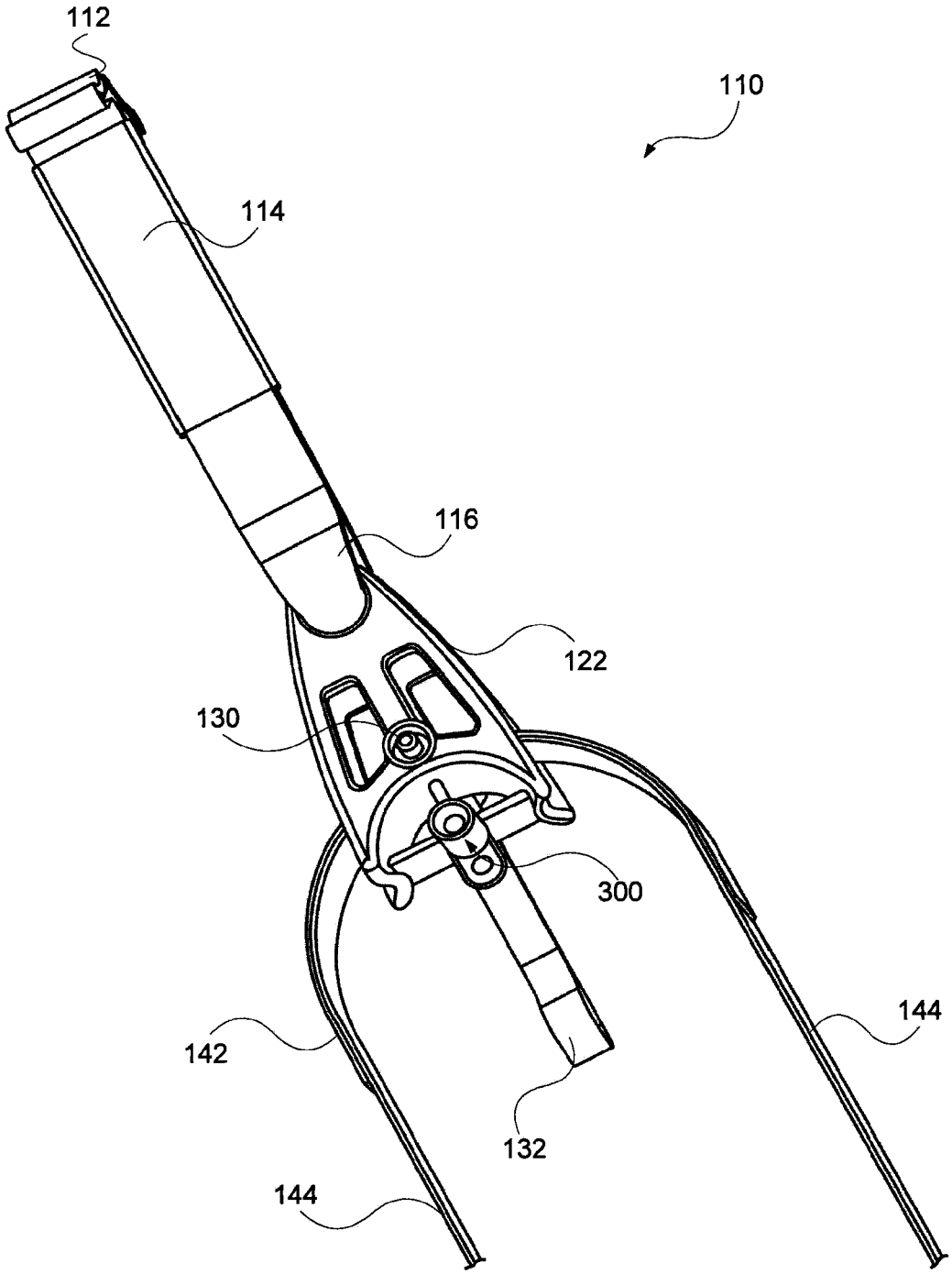
FIG. 3 is a frontal view of the upper portion of the exercise device of FIG. 1C, according to one embodiment.
Figure 4:
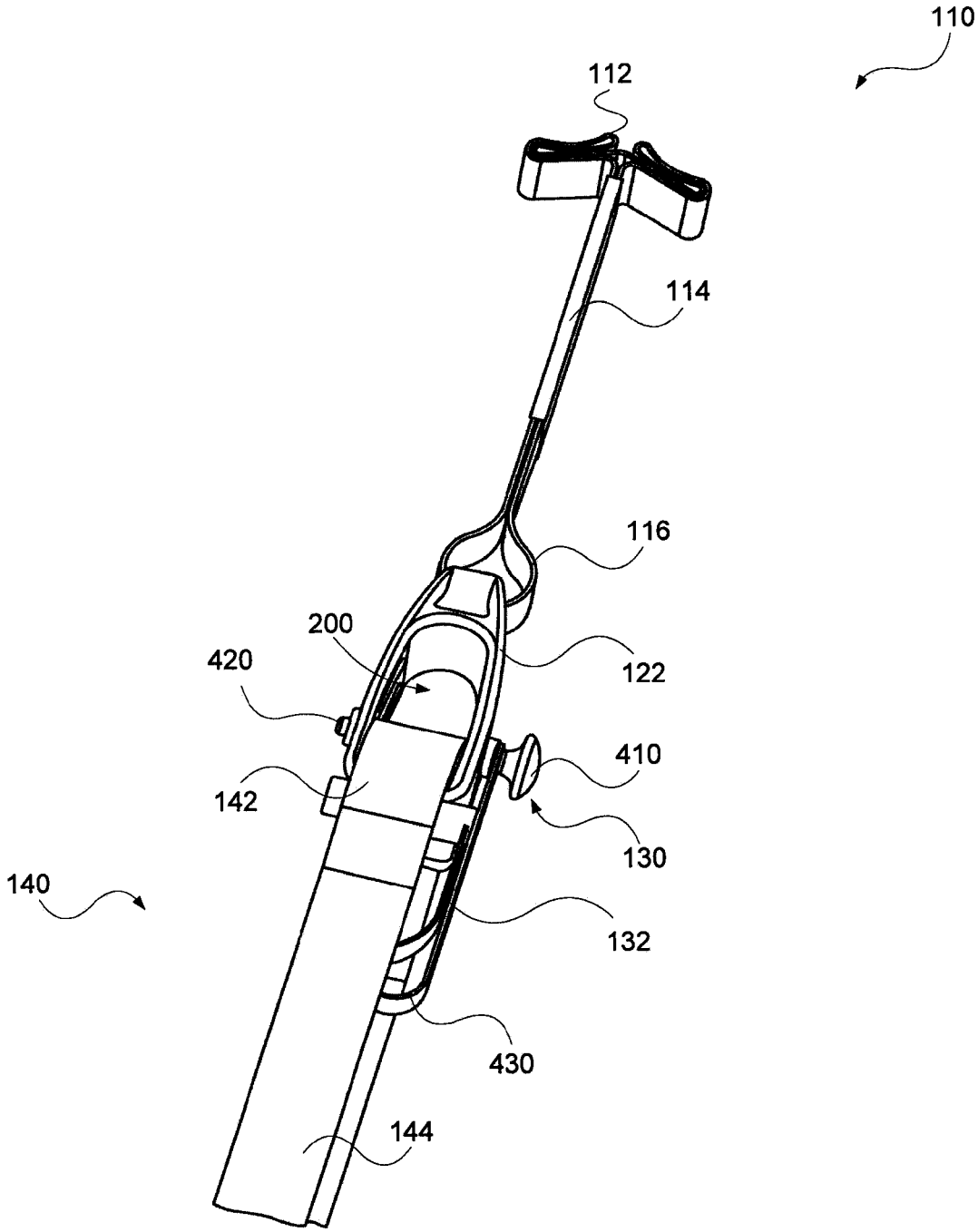
FIG. 4 is a side view of the upper portion of the exercise device of FIG. 1C, according to one embodiment.

FIGS. 2-4 illustrate various views of the upper portion of the assembled gravity based exercise device 100 of FIG. 1C, according to one embodiment. As illustrated, the central strap 144 is engaged with the substantially rigid yoke 120. Similarly, the anchor 110 is coupled to the substantially rigid yoke 120 through an anchor orifice 126 defined by the upper portion of the yoke 120. As shown, the loop 116 formed in the anchor strap 114 passes through the anchor orifice 126 to couple the anchor to the yoke. While the connection between the yoke 120 is illustrated and described herein as including a loop 116 passing through an orifice formed by the yoke, any number of coupling mechanisms may be used to couple the anchor 110 to the yoke. That is, the illustrated connection is beneficial because it provides the yoke with the ability to pivot relative to the anchor 110, thereby enhancing the lateral freedom of the entire exercise device 100 during use. However, other pivoting and non-pivoting coupling systems may similarly be used to couple the anchor 110 to the yoke 120 including, but in no way limited to, a mechanical fastener such as a ring, carabineer, and the like.

Additionally, according to one embodiment illustrated in FIGS. 2-4, the central strap 144 passes through the central strap translation channel 200 defined by the yoke housing 122 in order to selectively couple the elongated member 140 to the yoke 120. As shown in FIG. 2, the lower portion of the yoke 120 defining the central strap translation channel 200 is a surface identified as the yoke engagement surface 124 that is configured to receive and permit translation of the central strap 144 through the central strap translation channel 200. As illustrated, the yoke engagement surface 124 is approximately as wide as the central strap 144, and in some embodiments, slightly wider than the width of the central strap 144. As illustrated, the yoke engagement surface 124 may also assume a curved shape in order to reduce friction and/or provide for the dispersion of thermal energy during translation of the central strap 144 and to facilitate the return of the central strap in a similar direction from which it entered the yoke 120 in order to form the two arms 170*a*, 170*b*. According to one embodiment described in further detail below with reference to FIGS. 10-14, the entire yoke 120 and/or just the yoke engagement surface 124 may be formed of a material and have a surface finish designed to predictably vary the frictional interaction between the yoke engagement surface and the central strap. Furthermore, the material selected for the yoke 120 and/or just the yoke engagement surface 124 may be selected for its thermal dispersion properties to facilitate the dispersion of thermal energy during vigorous exercise. In one embodiment, detailed below with reference to FIG. 14, interchangeable inserts may be placed on the bottom of the central strap translation channel 200 in order to vary the frictional interaction between the yoke engagement surface and the center strap, thus adjust resistance in some strap movement based exercises. Conversely, or in addition to the above elements, according to one alternative embodiment, a replaceable member may be formed or placed on the bottom surface of the central strap 144 to vary the frictional interaction between the central strap and the yoke engagement surface 124.

FIGS. 2-4 also illustrate an interaction between the positioning pin 130 and the yoke 120 and/or the member fixation feature 142 formed on the central strap 144. As shown, when the arms 170 are substantially equal lengths, the member fixation feature 142 formed on the central strap 144 is disposed in the central strap translation channel 200 on the yoke engagement surface 124. When in this position, the member fixation feature 142 is aligned with the positioning pin 130 engaged with the yoke 120. As illustrated, the pin 130 includes a pin shaft 420 and pin head 410 that are sized to enable the pin shaft to pass the yoke housing 122, traverse the entire central strap translation channel 200, and engage the opposite wall of the yoke housing 122 via a pin fixation inlet 700 and outlet 710, illustrated in FIG. 7A. Specifically, with reference to FIG. 15, the pin 130 includes a pin head 410, a pin shaft 420, an engagement bevel 1510 formed on the shaft end opposite the pin head, and at least one optional pin retention member 1500 in the form of a spring loaded bearing. According to one embodiment, the pin shaft 420 is sized to traverse the pin fixation inlet 700 and outlet 710 while the pin head 410 acts as a stop to further insertion. Furthermore, the optional pin retention member 1500 may be used to create a biased interference fit aimed at maintaining insertion of the pin shaft 420. Additionally, a pin strap 132 having a pin strap loop 430 is coupled to the pin shaft 420 near the pin head 410 to aid in the attachment and/or removal of the pin 130 from the yoke 120. Moreover, returning to FIGS. 2-4, the yoke housing 122 defines a secondary pin orifice 300 that is sized to receive the pin shaft 420 without interacting or otherwise affecting the movement of the central strap 144.

According to this embodiment, when a user desires free movement of the central strap 144 through the central strap translation channel 200, the user may insert the pin shaft 420 in the secondary pin orifice 300 formed in the yoke 120. In this configuration, no contact is made between the pin shaft 420 and the member fixation feature 142 and the central strap 144 is allowed to translate, unobstructed in the central strap translation channel 200. This configuration may be selected by a user in order to participate in balance or dynamic strap movement based exercises. Alternatively, when a user desires, for purposes of storage or for a particular exercise, that the central strap 144 is fixed in a stable position relative to the yoke 120, the pin shaft 420 may be inserted into the pin fixation inlet 700 and outlet 710, illustrated in FIG. 7A such that the pin shaft 420 engages the member fixation feature 142 so as to prevent translational movement off the central strap 144 in the central strap translation channel 200.

Figure 5:
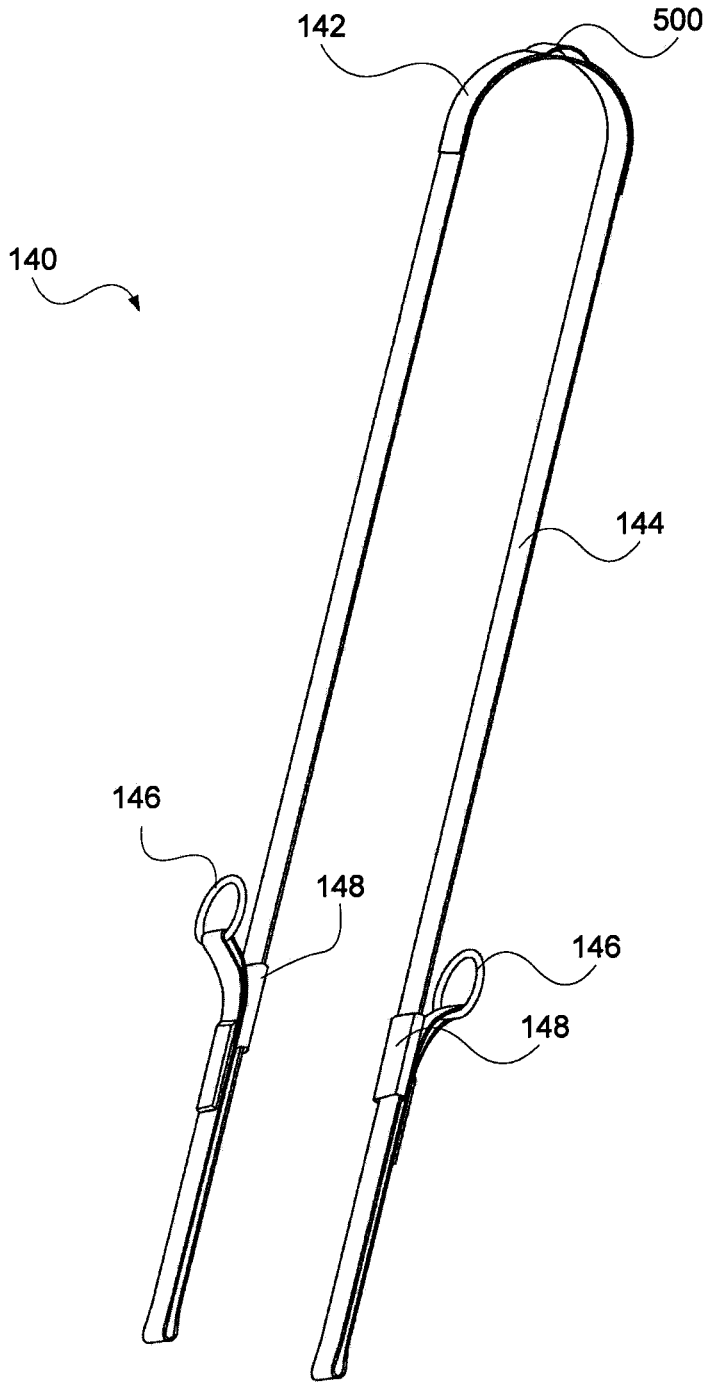
FIG. 5 is a perspective view of an elongated member of the exercise device of FIG. 1C, according to one embodiment.
Figure 6A:
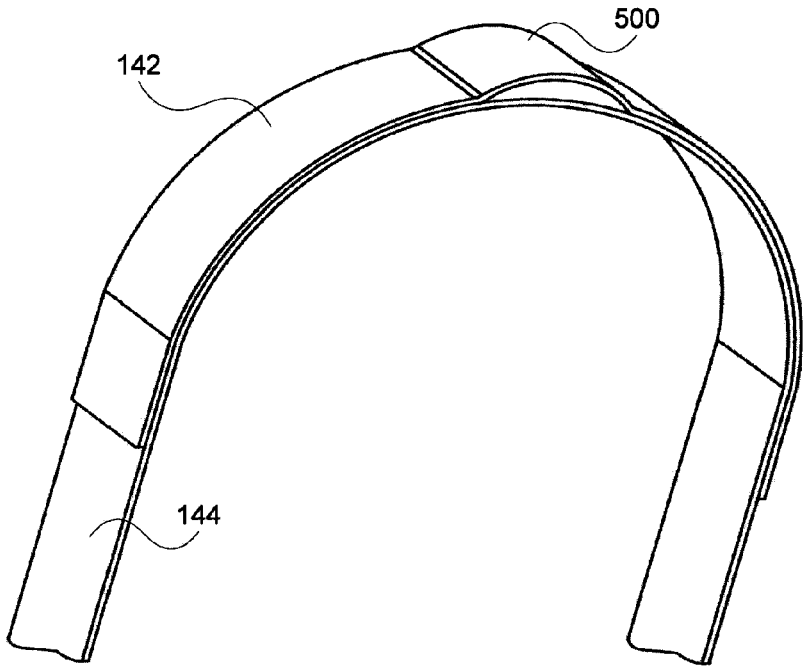
FIG. 6A is a perspective view of a member fixation feature of the exercise device of FIG. 1C, according to one embodiment.
Figure 6B:
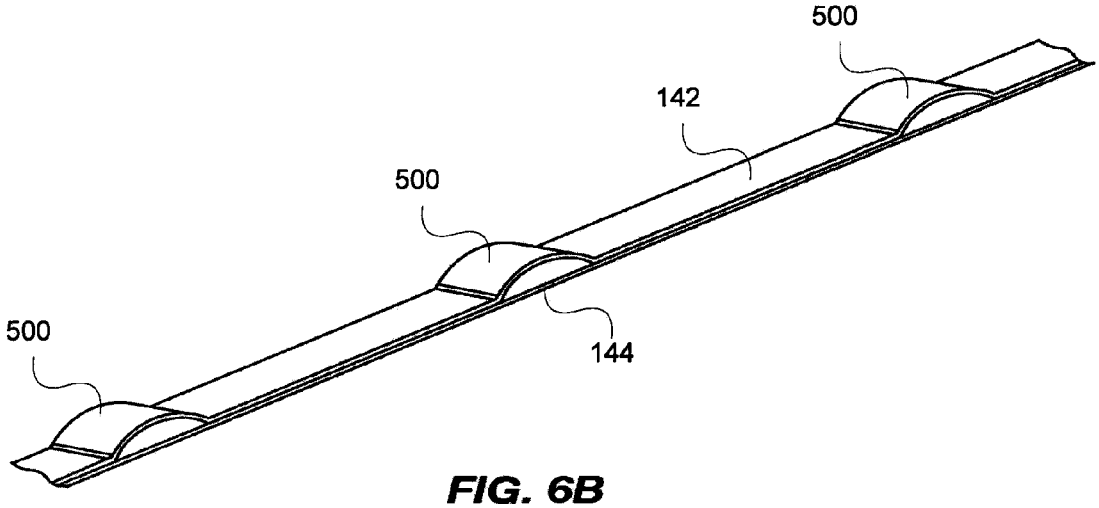
FIG. 6B is a top perspective view of a member fixation feature of the exercise device of FIG. 1C, according to one embodiment.

Specifically, according to one embodiment illustrated in FIGS. 5-6*b*, the elongation member 140 includes the central strap 144 having a member fixation feature 142 formed thereon. As illustrated in FIGS. 5 and 6*a*, the member fixation feature 142 may be an additional flexible strap coupled near the center point of the central strap 144. The additional flexible strap may be coupled to the central strap 144 via any known fastening method including, but not limited to adhesives or stitching. According to one embodiment, a pin engagement feature 500 is formed on the member fixation feature 142 in order to receive and securely couple the pin shaft 420 when inserted. According to the embodiment illustrated in FIGS. 5 and 6*a* a loop is formed in the member fixation feature 142 in order to form the pin engagement feature 500. According to this embodiment excess strap may be accumulated in a desired location, forming a loop, and a reinforcing stitch, adhesive, or other fastening means may be used to maintain the loop in the desired location. According to one embodiment the desired location may be at the midpoint of the central strap in order to enable fixation of the elongated member 140 such that the arms 170 are maintained at an equal length. As illustrated, the pin engagement feature is sized such that when the central strap 144 is in contact with the yoke engagement surface 124, the gap or lumen created by the pin engagement feature 500 will be both positioned and sized to receive the pin shaft 420 as it passes through the pin fixation inlet 700 and outlet 710, as shown in FIG. 4. Any subsequent attempted translation of the central strap 144 through the central strap translation channel 200 will be resisted by the pin shaft 420 engaging the yoke housing 122.

Alternatively, as illustrated in FIG. 6*b*, a plurality of pin engagement features 500 in the form of loops may be formed on the member fixation feature 142. According to this embodiment a user may select from multiple pin engagement features 142 to vary the relative lengths of the arms 170. According to this embodiment, a user may wish to perform uneven pushups or other similar exercises designed to place an unequal resistive force on a specified part of the body. Consequently, a user may arrange for the handles 160 to be at differing distances relative to one another, as measured from the yoke 120, by selecting different pin engagement features 500, as illustrated in FIG. 6*b*. While the present pin engagement feature 500 formed on the member fixation feature 142 is described herein as a loop formed in a second strap coupled to the central strap 144, any number of features may be formed in, on, or around the central strap in order to allow for the selective fixation of the central strap 144 relative to the yoke 120 including, but in no way limited to, molded reception orifices mechanically affixed to the central strap and the like.

Figure 16:
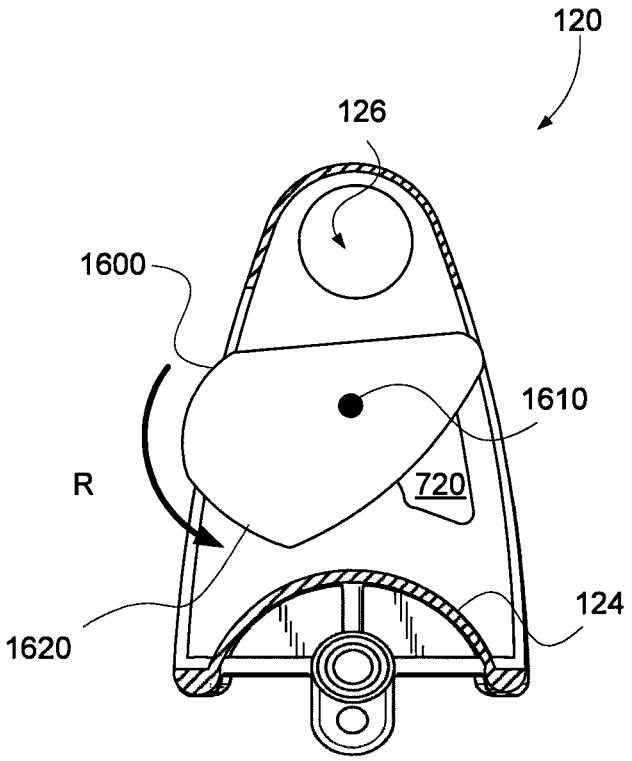
FIG. 16 is a cross-sectional side view of a rigid yoke including a strap retaining cam rotatably coupled thereto, according to one embodiment.

According to one alternative embodiment, positional fixation of the central strap 144 relative to the yoke 120 may be accomplished with mechanisms other than a pin/orifice engagement or other similar interference systems. For example, according to one alternative embodiment illustrated in FIG. 16, a cam member 1600 or a bi-stable lever may be pivotably coupled to the yoke housing 122 about a pivot axis 1610 within the central strap translation channel. According to this embodiment, when the central strap 144 is in a desired location, the user may rotate the cam a direction R, causing a lobe 1620 to engage the central strap and secure the central strap against the yoke engagement surface 124 such that it can no longer translate relative to the yoke 120. According to this embodiment, when the user again desires free motion of the central strap 144 relative to the yoke 122, the cam may be rotated in an opposite direction removing the protruding lobe 1620 from the central strap 144 and restoring free motion to the exercise device 100.

Figure 7A:
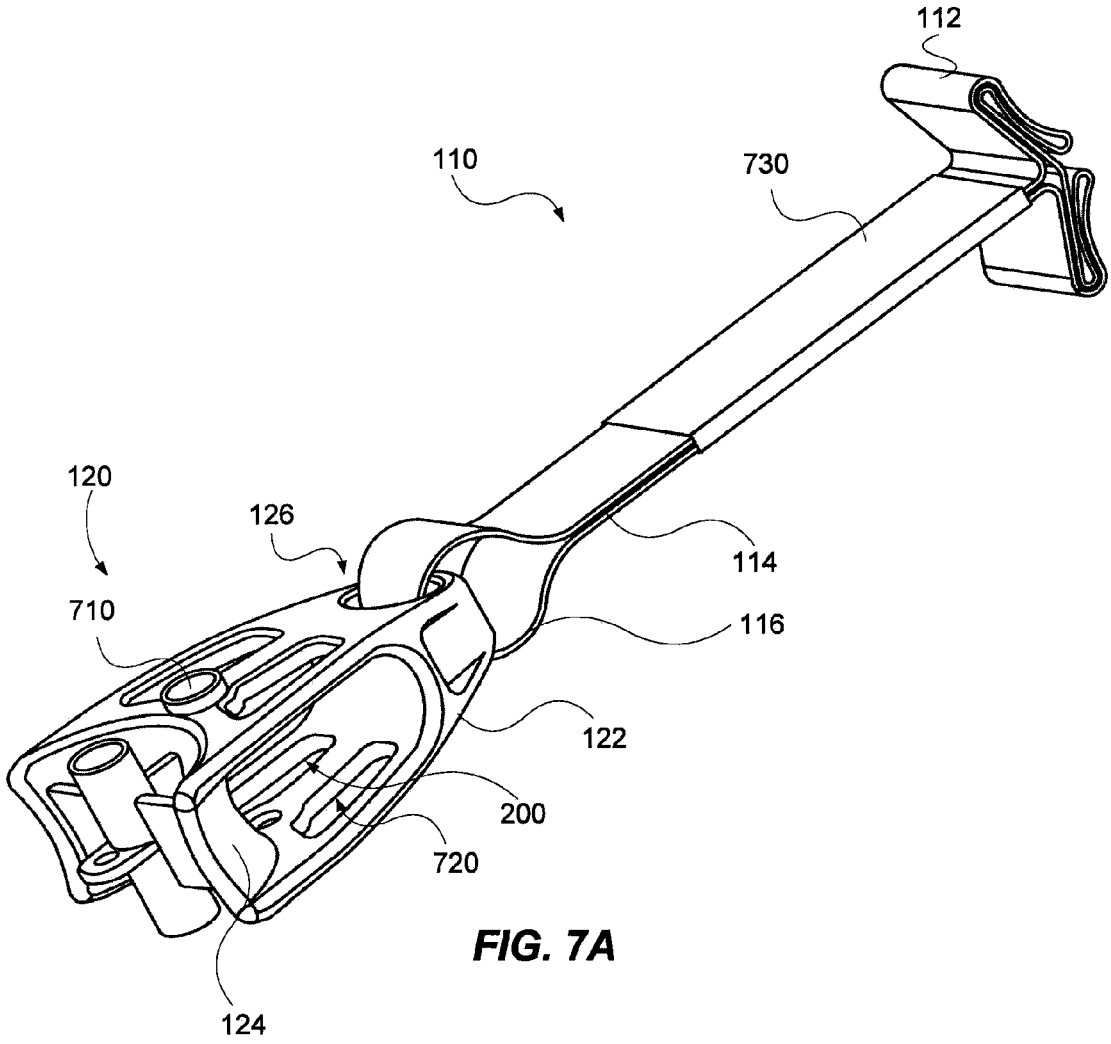
FIGS. 7A and 7B are perspective views of an anchor and yoke assembly configured for use with an exercise device, according to various embodiments.
Figure 7B:
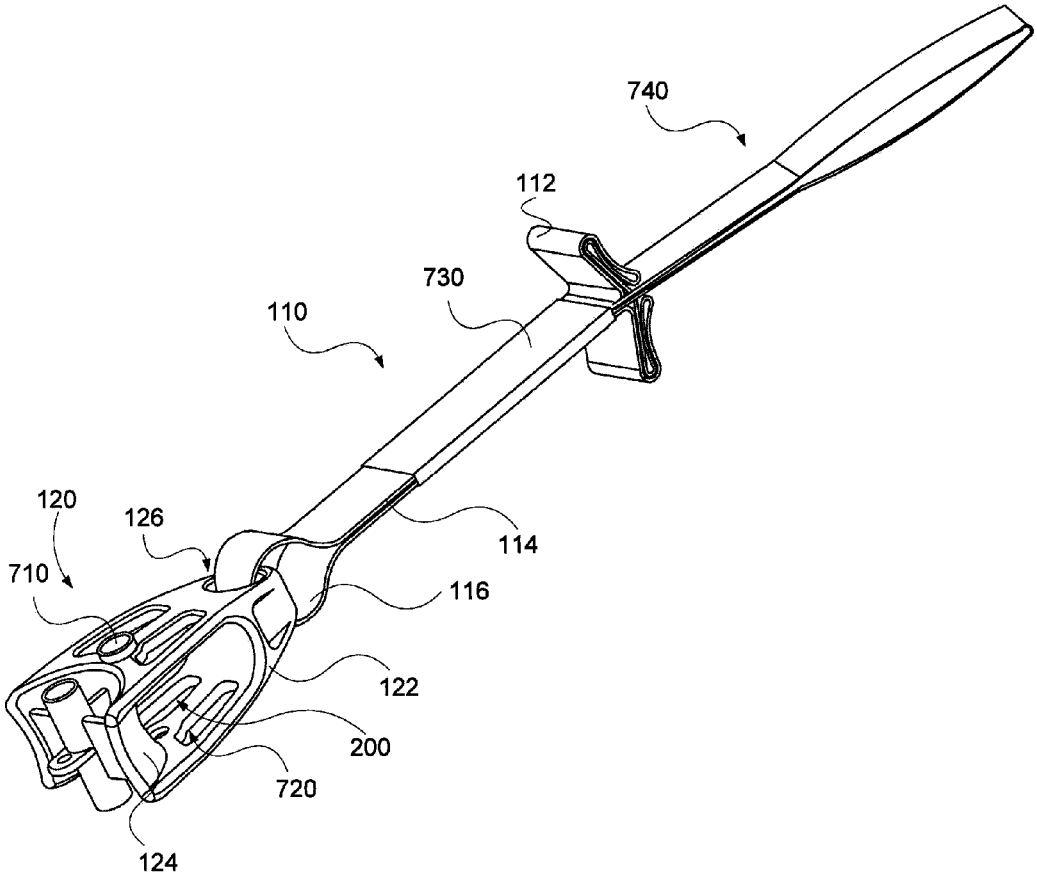
Figure 8:
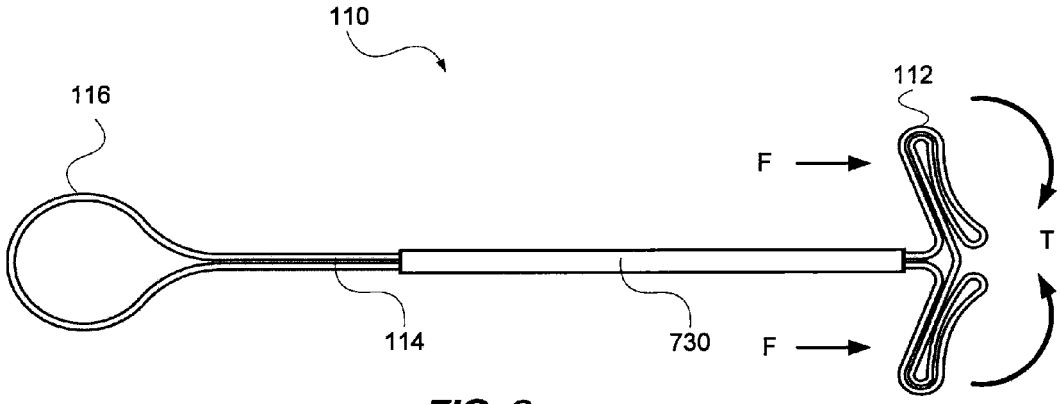
FIG. 8 is a side view of an anchor configured for use with an exercise apparatus, according to one embodiment.

FIGS. 7A-8 present several views of the anchor 110, where FIG. 7A is a perspective view of the anchor coupled to the yoke 120 and FIG. 8 is a side view of the anchor. As noted previously, the anchor 110 includes an inelastic, flexible anchor strap 114 defining a loop on one end and coupling an anchor base 112 on the other. According to one embodiment, the anchor 110 including the anchor base 112, anchor strap 114, and loop 116 are formed of materials that include, but are not limited, to straps of a webbing of a natural or synthetic material having a strength sufficient to support the weight of a user. Preferred webbings include, but are not limited to, webbings made of nylon, polypropylene or other polymeric fibers. It is understood that a single length of flexible material according to the present system and method can alternatively comprise two or more pieces that are stitched, glued, or otherwise attached to one another. According to one embodiment, the length of anchor 110 may vary from 4 to 30 inches, and may be approximately 12 inches in length, in one embodiment.

As illustrated in FIG. 7B, an elongated tether 740 may optionally be coupled to the anchor base 112. According to one embodiment, the elongated tether 740 may be any structural strap or coupling device configured to serve as an additional or optional anchor member for securing the exercise device 100. According to one embodiment, the elongated tether 740 may include a loop and hook, buckle, or other securing member configured to allow the elongated tether to securely attach to an object such as a branch, car, swing set, railing, chin-up bar, or other structural object. This allows the exercise device 100 to optionally be secured to additional objects besides a door.

Continuing with FIG. 7A through FIG. 8, the anchor strap 114 may optionally include a wear reinforcement member 730 covering at least one surface of the anchor strap. As illustrated, the optional wear reinforcement member 730 may be any added material configured to prevent excessive wear on the anchor strap 114 where the anchor strap engages a door. According to one embodiment, the optional wear reinforcement member 730 may include, but is in no way limited to, an additional strap of nylon, polypropylene, polyethylene, or other polymeric fibers.

As illustrated in FIGS. 7A, 7B, and 8, the anchor base 112 of the anchor 110 includes an enlarged first end that is wider than the anchor strap. Since one of the intended uses of the anchor 110 is to anchor the exercise device 100 between a door and jamb, it is preferable that the end 112 include materials that are soft enough to prevent damage to a wood door or door frame, yet be sturdy enough to support the weight of a user. As shown in FIG. 8, the anchor strap 114 has an end that is made of a continuation of the strap. According to one embodiment, the material making the anchor strap 114 is folded into two opposing folds having opposing directions of fold. Specifically, as illustrated in the embodiment of FIG. 8, the anchor base 112 includes a first fold having a clockwise fold direction and a second fold having a counterclockwise fold direction. The opposing folds making up the anchor base 112 of FIG. 8 can be formed by gluing and/or stitching the strap end back upon itself in the indicated direction. According to this embodiment, when the anchor base 112 is engaged by a door and jamb, a force F is exerted on the back side of each fold. This force F causes the opposing folds to fold into themselves in the same direction as their respective fold directions T. As each opposing fold receives a substantially equal force encouraging further tightening of the opposing folds, neither fold is undone or shifts relative to the other. Consequently, the enlarged anchor base 112 created by the opposing folds is maintained and prevents passage of the entire anchor 110 between the door and jamb.

Figure 9A:
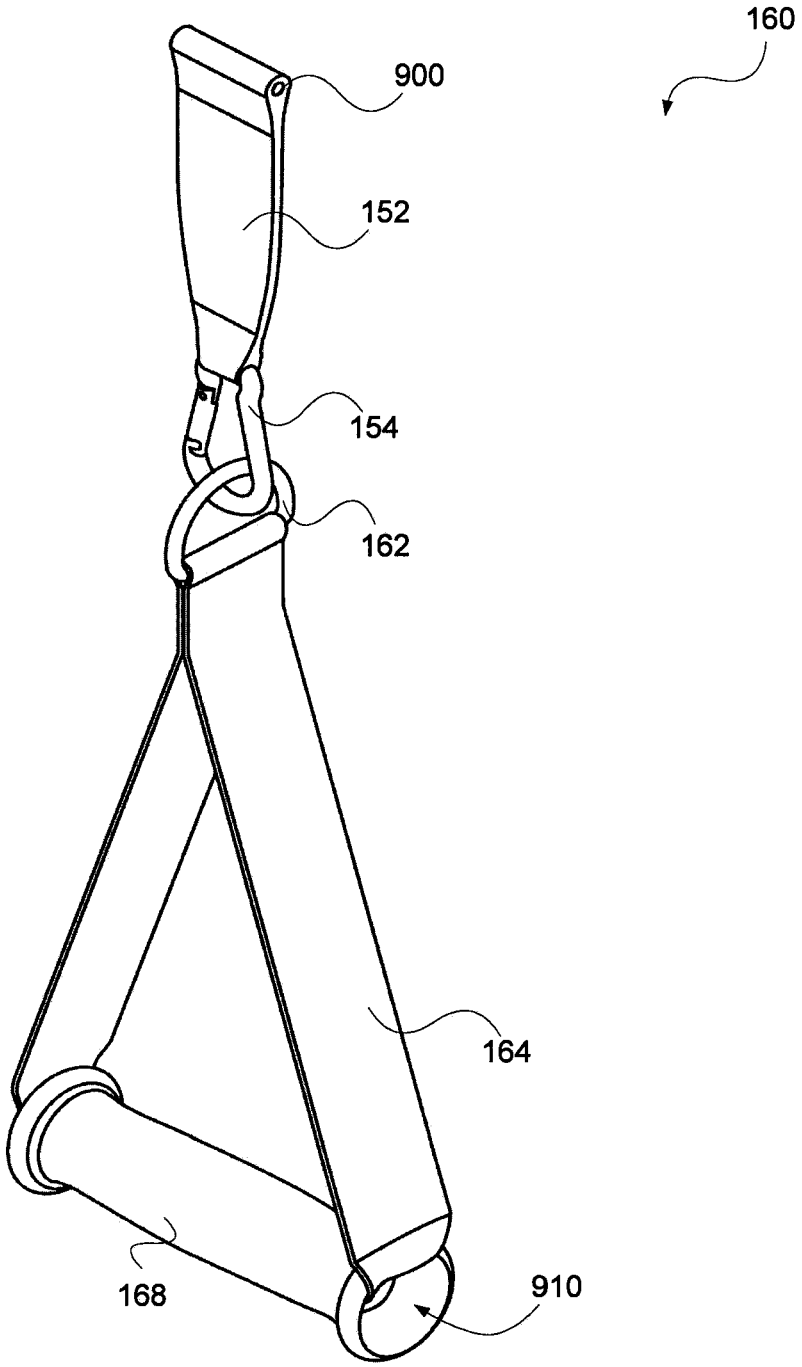
FIGS. 9A and 9B are perspective views of a handle configured for use with an exercise apparatus, according to various embodiments.
Figure 9B:
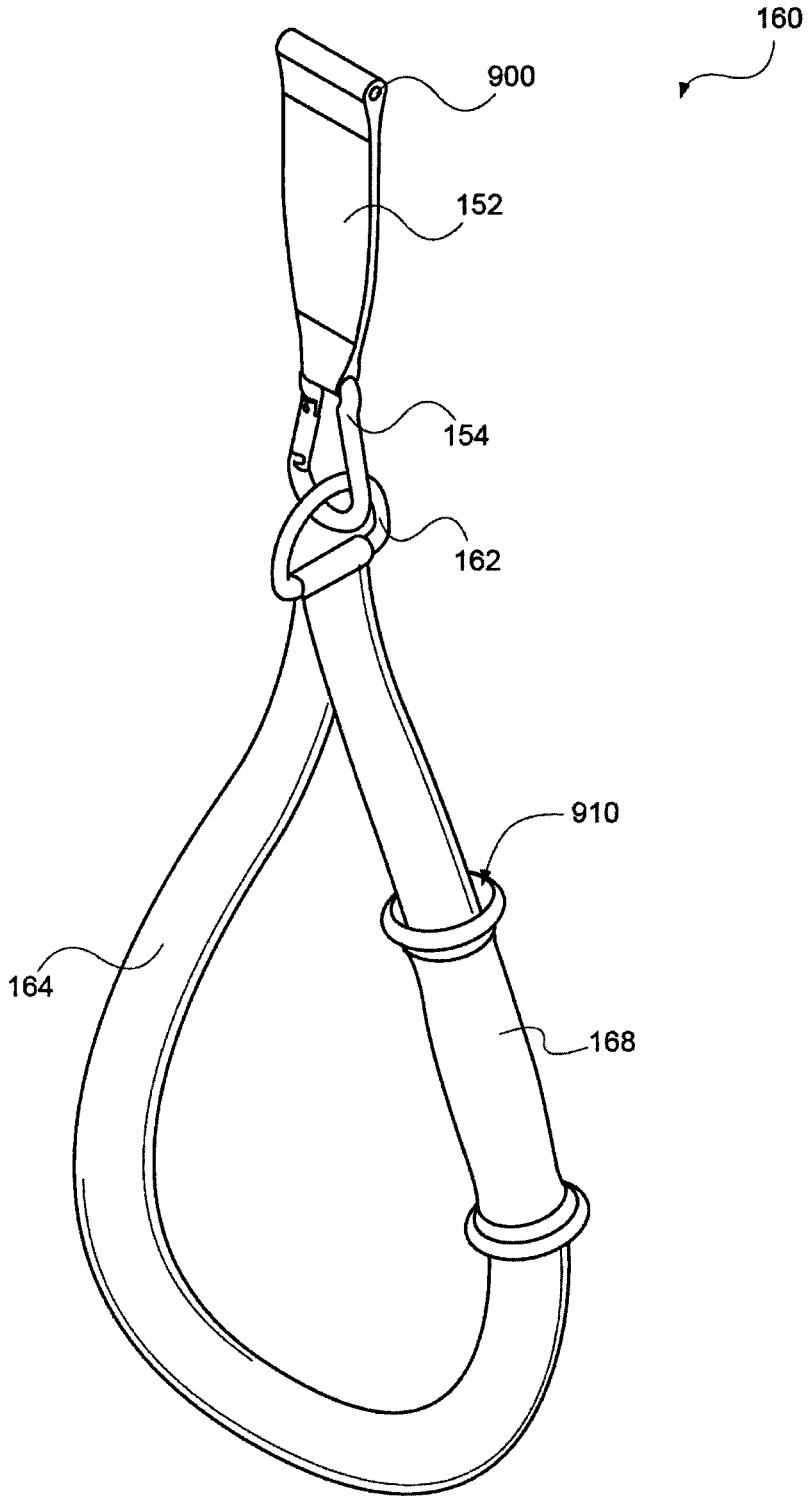
Figure 10:
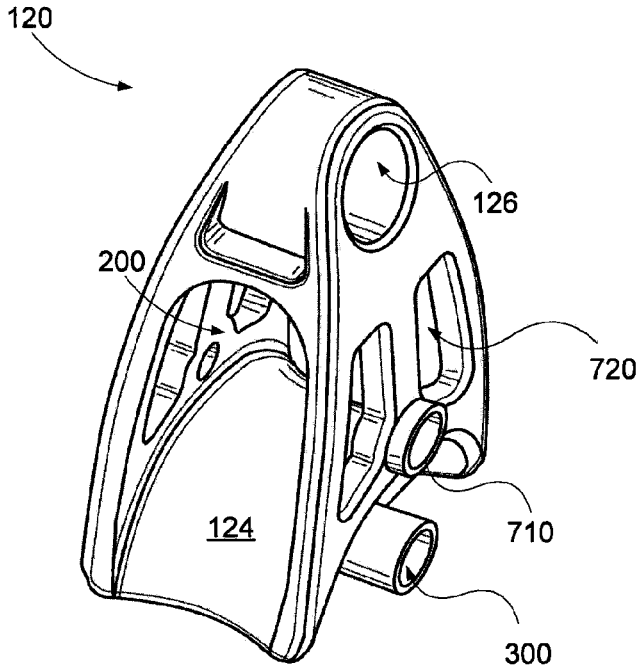
FIG. 10 is a top perspective view of a rigid yoke configured for use with an exercise apparatus, according to one embodiment.
Figure 11:
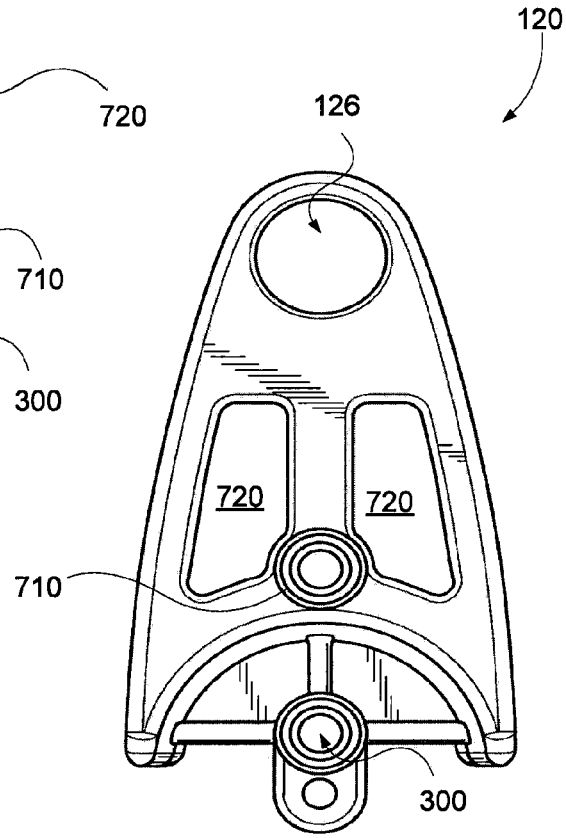
FIG. 11 is a frontal view of a rigid yoke configured for use with an exercise apparatus, according to one embodiment.
Figure 12:
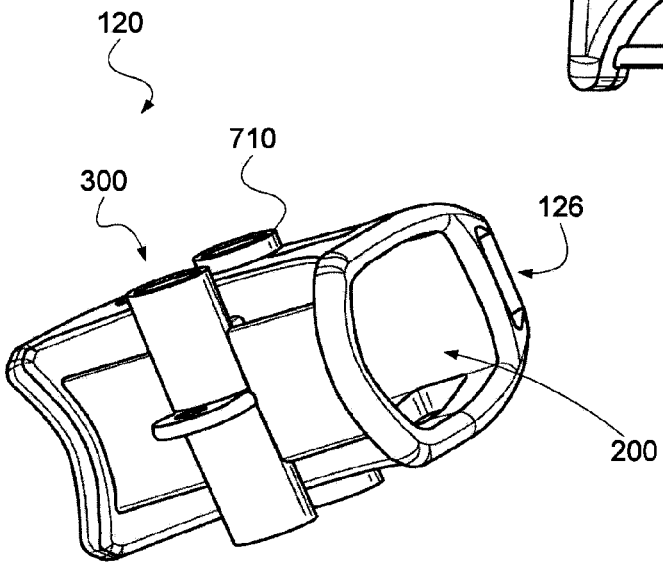
FIG. 12 is a bottom perspective view of a rigid yoke configured for use with an exercise apparatus, according to one embodiment.
Figure 13:
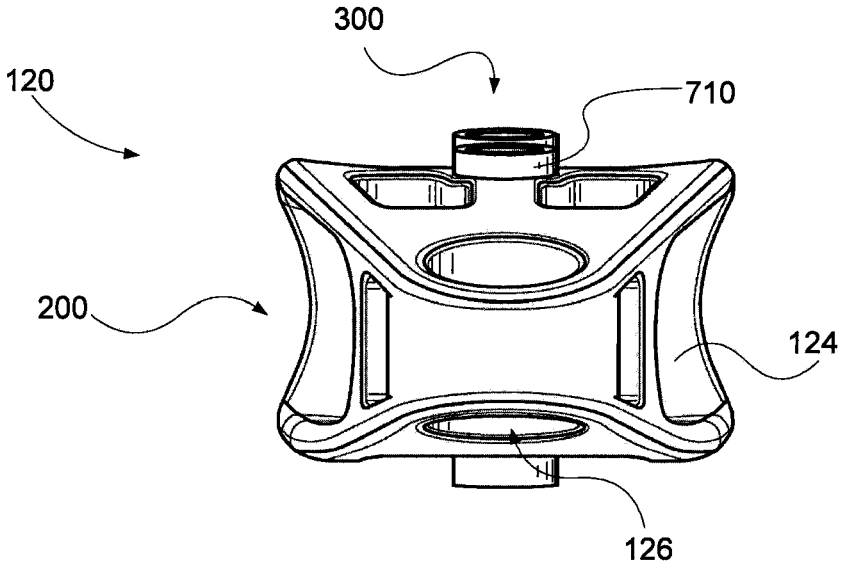
FIG. 13 is a top view of a rigid yoke configured for use with an exercise apparatus, according to one embodiment.

As noted above, the anchor 110 is configured to resist pulling forces exerted on the exercise device 100 during use by a user imparting a force on the handles 160. FIG. 9A is a perspective view of a handle configured for use with an exercise apparatus, according to one embodiment. As illustrated in FIG. 9A, the handle 160 includes a handle loop 164 that may be formed of the same or similar strap material as the central strap 144. Alternatively, the handle 160 may be made of other different materials or an entirely different form. The handle loop 164 is coupled at a first end to a handle engagement member 162 illustrated herein as a ring configured to be directly coupled to an extension engagement member 154 in the form of a carabineer. While a loop and carabineer mating engagement is illustrated in FIG. 9A, any number of mechanically mating systems may be used to connect the handle 160 to the buckle extension 152. On the second end of the handle loop 164, a grip 168 or other exercise facilitating member may be found. According to the illustrated embodiment, the grip 168 includes a handle loop lumen 910 passing through the center of the grip. Specifically, the grip 168 has a generally tubular shape, with an outer cover and an inner cylindrical tubular portion defining a handle loop lumen 910. The handle loop lumen 910 is sized to provide space for the handle loop 164 to pass there through. While FIG. 9A focuses on a handle 160 having grips 168, a variety of other add-on grip accessories or grips and handles of varying designs, not shown, can be used with exercise device 100 by merely coupling the add-on grip accessories to the extension engagement member. For example, according to one embodiment, the handle grips detailed above may be replaced by a number of alternative accessories, including but not limited to a rope grip for forearm development, a finger grip for lighter workouts, and/or a heel cup accessory for securing the feet to the handles for leg development exercises. Furthermore, as illustrated in FIG. 9B, the handle 160 may include a circular cross section, formed of a flexible material such as nylon along with a somewhat flexible grip 168.

Coupled to the extension engagement member 154 is the buckle extension 152 including a strap having a buckle mating orifice 900 on a first end and an engagement member orifice 920 on a second end. As illustrated in FIG. 1C, the buckle extension 152 is configured to transition the elongated member 140 from the length adjustment mechanisms 150 to an extension engagement member 154. The buckle mating orifice 900 is configured to securely receive and couple a portion of the length adjustment mechanism 150. While the buckle mating orifice 900 is illustrated as an orifice defined by the buckle extension that receives and secures the length adjustment mechanism 150, any number of mechanical fasteners, adhesives, and the like may be used to couple the buckle extension 152 to the length adjustment mechanism 150. Similarly, the engagement member orifice 920 is configured to securely receive and couple a portion of the extension engagement member 154. While the engagement member orifice 920 is illustrated as an orifice defined by the buckle extension 152 that receives and secures the extension engagement member 154, any number of mechanical fasteners, adhesives, and the like may be used to couple the buckle extension 152 to the extension engagement member 154.

FIGS. 10-13 illustrate various views of the substantially rigid yoke 120, according to one embodiment. As illustrated, the substantially rigid yoke 120 includes a yoke housing 122 defining a number of features including, but in no way limited to, the central strap translation channel 200, the anchor orifice 126, the pin fixation inlet 700, the pin fixation outlet 710, the secondary pin orifice 300, and the yoke engagement surface 124. As noted above, the anchor orifice 126 is configured to engage and pivotably couple the anchor strap 114. Similarly, the pin fixation inlet 700 and pin fixation outlet 710 are configured to receive the positioning pin 130 and position the pin adjacent to the yoke engagement surface 124 such that the positioning pin 130 or other similar fixation device may engage a mating feature on the member fixation feature to selectively fix the position of the central strap 144 relative to the yoke 120. Additionally, the secondary pin orifice 300 is formed in the substantially rigid yoke 120 in a position out of contact with a central strap 144 traversing the central strap translation channel. According to one embodiment, the secondary pin orifice 300 is configured to securely house the positioning pin 130 when free translation of the central strap 144 through the central strap translation channel 200 is desired. Additionally, the yoke housing 122 may define a number of material reliefs 720 where material has been removed for weight considerations.

Figure 14:
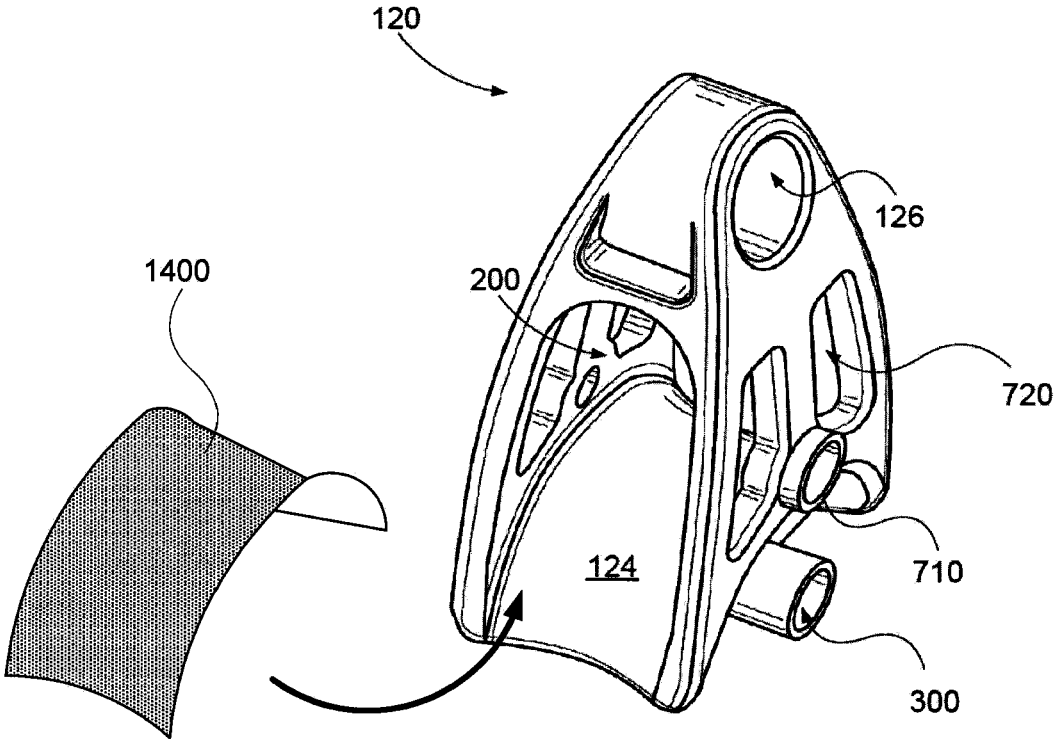
FIG. 14 is a perspective view of a rigid yoke including a changeable insert, according to one embodiment.
Figure 15:
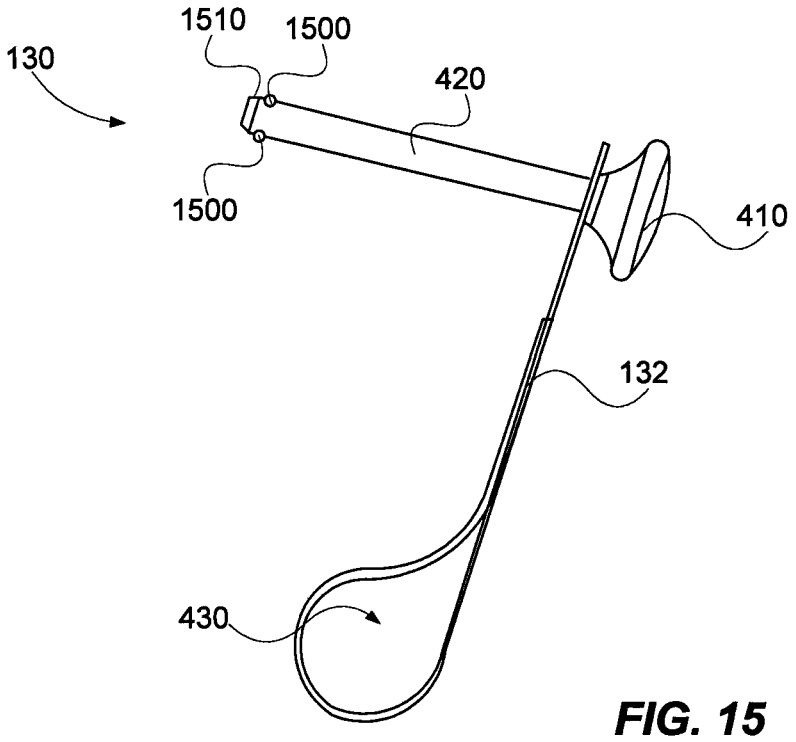
FIG. 15 is a side view of positioning pin configured for use with the rigid yoke of FIGS. 10-14, according to one embodiment.

As noted previously, the yoke engagement surface 124 may be designed to provide a known desired frictional interaction with the central strap 144. Specifically, according to one embodiment, the material used to form the yoke engagement surface 124 may be selected to provide a low coefficient of friction, a high coefficient of friction, increased durability, or any combination thereof. The desired material properties may be imparted on the yoke engagement surface 124 by manufacturing the entire yoke of a material having the desired properties. Alternatively, the yoke may be manufactured of a first material and the yoke engagement surface 124 may then be an insert permanently affixed to the yoke 120. FIG. 14 illustrates yet another embodiment for selectively modifying the coefficient of friction of the yoke engagement surface 124. As illustrated in FIG. 14, an insert 1400 may be configured to be removably inserted into the central strap translation channel 200 such that it covers the yoke engagement surface 124 and adds a known coefficient of friction to the yoke engagement surface 124. According to this embodiment, a user may selectively insert an insert 1400 having a known surface finish or material properties that correspond with a desired frictional interaction.

According to one embodiment, the substantially rigid yoke 120 may be manufactured out of any number of substantially rigid materials including, but in no way limited to, a polymer including but not limited to glass filled nylon, polycarbonate, thermal set polyester, epoxy, metal including but not limited to brass, aluminum, composites, and the like. Additionally, the substantially rigid yoke 120 may be manufactured using any number of manufacturing processes including, but in no way limited to, molding, machining, casting, and the like.

According to one embodiment, at least one outer surface of the yoke 120 may be coated with a rubberized polymer to modify the surface finish and/or frictional characteristics of the outer surface of the yoke. Additional materials, such as cloth, gel, etc. may be used to adjust the surface features of the yoke 120 for purposes of engagement with a door or wall.

INDUSTRIAL APPLICABILITY

In general, the structure of the present disclosure provides small lightweight apparatus that enables the performance of numerous gravity resistance based exercises. More specifically, the present system and method provides an inelastic exercise device that is supported by, or that can be easily attached to, a supporting structure, and that allows a user to perform a large number of exercises by easily adjusting the length of the device, selectively fixing the relative position of the handles, and thereafter selectively fixing the position of the strap relative to the yoke.

In general, a user sets the exercise device to a desired length, positions herself on the ground near the exercise device, supports a portion of her body weight from the exercise device by her hands or feet, and exercises by moving her body with her weight supported by the ground and the exercise device. Examples of support on the ground and exercise device include, but are not limited to, standing on one or both legs, lying on the stomach or the back, kneeling, or by having the hands on the ground, and having the exercise device support ones weight by the hands or feet, as appropriate.

Furthermore, according to one configuration, the present system includes an anchor system for coupling the system to a door and jamb or other structural member, an inelastic strap forming a pair of arms for performing bodyweight based resistive exercises, and a yoke member coupling the inelastic strap to the anchor. The anchor includes an upper portion for coupling the anchor and a lower portion for coupling the inelastic strap. The lower portion of the yoke member configured for connecting the inelastic strap includes a channel configured to provide predictable translation of the inelastic strap during motion based exercises.

Additionally, the present yoke member includes a number of features configured to enable the selective insertion of a pin into the yoke member. According to the present system and method, the selective insertion of the pin is configured to engage the inelastic strap and fix the position of the inelastic strap within the yoke. Selective fixation of the inelastic strap provides a user with the ability to perform numerous exercises that call for a fixed handle position, such as exercises incorporating offset hand positions to focus on a single side or area of the body.

Optionally, the yoke member may be configured to receive a removable insert that forms the surface of the yoke member that engages the inelastic strap as it is translated through the yoke during motion based exercises. The removable insert may be formed of a material having known desirable properties, such as wear properties and coefficient of friction properties. Additionally, the surface finish or features of the removable insert may be designed to impart a desired force upon the inelastic strap during dynamic engagement. Accordingly, a new user experience may be provided and adjusted with a mere change of the insert.

Additionally, the present system incorporates a lightweight anchor system configured to leverage the force exerted by a user to maintain the structural integrity of the anchor. Specifically, the present anchor system includes two folded members having opposing fold directions folding into one another. As a force is imparted on the present system, the opposing folds are tightened in opposite directions and impart opposing forces on one another while maintaining their structural configuration.

In conclusion, the present system and method provides a compact exercise system that enables the performance of multiple exercises by maximizing the user's positioning options. More specifically, the present system incorporates a yoke member configured to allow for the performance of traditional inelastic strap based exercises that leverage free translation of the inelastic strap while additionally providing for the selective fixation of the inelastic strap for the safe and efficient performance of more stationary exercises.

What is claimed is:

1. An exercise apparatus, comprising:

an elongated member having a pair of ends, wherein said elongated member is an inelastic strap;

an anchor having a first portion for mounting to a structure and a second coupling portion; and a rigid yoke including a yoke housing having a first end and a second end, wherein said first end of said yoke housing is coupled to said second coupling portion of said anchor and said second end of said yoke housing defines a translation channel configured to receive said elongated member;

said at least one fixation member comprises a positioning pin including a shaft and at least one shaft receiving orifice defined by said yoke housing adjacent to said translation channel, said at least one shaft receiving orifice being sized to securely receive said shaft;

wherein said rigid yoke further comprises at least one fixation member configured to selectively fix a position of said elongated member within said translation channel by inserting a positioning pin into at least one fixation feature formed on a discrete location of said elongated member;

wherein said at least one shaft receiving orifice defined by said yoke housing adjacent to said translation channel further comprises a first shaft receiving orifice defined by a front surface of said yoke housing and a second shaft receiving orifice defined by a back surface of said yoke housing with said translation channel disposed between said first shaft receiving orifice and said second shaft receiving orifice, wherein when said shaft is inserted into said first shaft receiving orifice and said second shaft receiving orifice said shaft traverses said translation channel.

2. The exercise apparatus of claim 1, wherein said fixation feature is sized to receive said shaft when inserted in said at least one shaft receiving orifice to positionally fix said inelastic strap in said translation channel.

3. The exercise apparatus of claim 2, wherein said fixation feature is formed on a center point of a length of said inelastic strap.

4. The exercise apparatus of claim 2, wherein said fixation feature comprises a loop formed on a top surface of said inelastic strap.

5. The exercise apparatus of claim 2, further comprising a plurality of fixation features formed on said inelastic strap.

6. The exercise apparatus of claim 1, wherein said at least one fixation member comprises a cam rotatably coupled to said yoke housing within said translation channel.

7. The exercise apparatus of claim 1, wherein said translation channel defined by said yoke housing is further defined by a yoke engagement surface formed on said second end of said yoke housing;

wherein said yoke engagement surface defines a lower portion of said translation channel.

8. The exercise apparatus of claim 7, wherein said yoke is formed from a first material and said yoke engagement surface is formed of a second material.

9. The exercise apparatus of claim 8, wherein said second material has a lower coefficient of friction than said first material.

10. The exercise apparatus of claim 7, further comprising a removable insert member configured to removably engage with said yoke engagement surface.

11. The exercise apparatus of claim 1, wherein:

said second coupling portion of said anchor comprises a flexible loop; and said first end of said yoke housing further includes an anchor orifice defined by said yoke housing, said anchor orifice being coupled to said flexible loop.

12. The exercise apparatus of claim 1, wherein said first portion of said anchor for mounting to a structure comprises:

a first strap loop folded in a first fold direction; and a second strap loop folded in a second fold direction;

wherein said first strap loop and said second strap loop are positioned adjacent to one another such that said first fold direction and said second fold direction are converging.

13. An exercise apparatus, comprising:

an elongated member having a pair of ends, wherein said pair of ends each includes a handle, wherein said elongated member is an inelastic strap;

an anchor having a first portion for mounting to a structure and a second coupling portion including a loop; and a rigid yoke including a yoke housing having a first end and a second end, wherein said first end of said yoke housing is coupled to said loop of said anchor and said second end of said yoke housing defines a translation channel configured to receive said elongated member;

wherein said rigid yoke further comprises at least one fixation member configured to selectively fix a position of said elongated member within said translation channel by inserting a positioning pin into at least one fixation feature formed on a discrete location of said inelastic strap;

wherein said yoke comprises at least one shaft receiving orifice adjacent to said translation channel further comprises a first shaft receiving orifice defined by a front surface of said yoke housing and a second shaft receiving orifice defined by a back surface of said yoke housing with said translation channel disposed between said first shaft receiving orifice and said second shaft receiving orifice, wherein when said shaft is inserted into said first shaft receiving orifice and said second shaft receiving orifice said shaft traverses said translation channel.

14. The exercise apparatus of claim 13, wherein said at least one fixation member comprises:

the positioning pin including a shaft; and at least one shaft receiving orifice defined by said yoke housing adjacent to said translation channel, said at least one shaft receiving orifice being sized to securely receive said shaft;

wherein said at least one fixation feature being sized to receive said shaft when inserted in said at least one shaft receiving orifice to positionally fix said inelastic strap in said translation channel.

15. The exercise apparatus of claim 13, wherein said translation channel defined by said yoke housing is further defined by a yoke engagement surface formed on said second end of said yoke housing;

wherein said yoke engagement surface defines a lower portion of said translation channel.

16. The exercise apparatus of claim 13, wherein said first portion of said anchor for mounting to a structure comprises:

a first strap loop folded in a first fold direction; and a second strap loop folded in a second fold direction;

wherein said first strap loop and said second strap loop are positioned adjacent to one another such that said first fold direction and said second fold direction are converging.

17. An exercise apparatus, comprising:

an elongated member having a pair of ends, wherein said pair of ends each includes a handle, wherein said elongated member is an inelastic strap;

an anchor having a first portion for mounting to a structure and a second coupling portion including a flexible loop; and a rigid yoke including a yoke housing having a first end and a second end, wherein said first end of said yoke housing is coupled to said flexible loop of said anchor and said second end of said yoke housing defines a translation channel configured to receive said elongated member, wherein said translation channel defined by said yoke housing is further defined by a yoke engagement surface formed on said second end of said yoke housing, wherein said yoke engagement surface defines a lower portion of said translation channel;

wherein said rigid yoke further comprises at least one fixation member configured to selectively fix a position of said elongated member within said translation channel; and wherein said at least one fixation member includes a positioning pin including a shaft, and at least one shaft receiving orifice defined by said yoke housing adjacent to said translation channel, said at least one shaft receiving orifice being sized to securely receive said shaft, wherein said inelastic strap further includes at least one fixation feature formed on a discrete location of said inelastic strap, said at least one fixation feature being sized to receive said shaft when inserted in said at least one shaft receiving orifice to positionally fix said inelastic strap in said translation channel;

wherein said yoke comprises at least one shaft receiving orifice adjacent to said translation channel further comprises a first shaft receiving orifice defined by a front surface of said yoke housing and a second shaft receiving orifice defined by a back surface of said yoke housing with said translation channel disposed between said first shaft receiving orifice and said second shaft receiving orifice, wherein when said shaft is inserted into said first shaft receiving orifice and said second shaft receiving orifice said shaft traverses said translation channel.

* * * * *